US005392902A

United States Patent [19]

Vlastakis

[11] Patent Number: 5,392,902

[45] Date of Patent: Feb. 28, 1995

[54] MERCHANDISE DISPLAY DEVICE

[75] Inventor: Kirk A. Vlastakis, Clemmons, N.C.

[73] Assignee: Alliance Display and Packaging Company, Winston-Salem, N.C.

[21] Appl. No.: 161,807

[22] Filed: Dec. 6, 1993

[51] Int. Cl.[6] ..... B65D 5/50; A47B 47/06; A47F 5/11

[52] U.S. Cl. ..... 206/45; 108/165; 108/193; 211;135;149/248; 211;135;149/174; 312/259

[58] Field of Search ..... 206/45, 45.11; 211/135, 211/188, 149, 195; 312/257.1, 258, 259, 108; 248/174; 108/165, 193, 110

[56] References Cited

U.S. PATENT DOCUMENTS

| | | | |
|---|---|---|---|
| 1,902,566 | 3/1933 | Marsh | 248/174 X |
| 1,927,171 | 9/1933 | Horwath | 248/174 X |
| 2,135,093 | 11/1938 | Abrams | 248/174 X |
| 2,153,422 | 4/1939 | Kroman | 211/135 X |
| 2,155,190 | 4/1939 | Heinz | 211/135 X |
| 2,256,339 | 9/1941 | Fallert | 312/259 X |
| 3,863,575 | 2/1975 | Kuns et al. | 211/135 X |
| 4,311,100 | 1/1982 | Gardner et al. | 108/165 |
| 4,506,790 | 3/1985 | Muscari | 248/174 X |

*Primary Examiner*—Bryon P. Gehman
*Attorney, Agent, or Firm*—Herbert J. Bluhm

[57] ABSTRACT

A merchandise display device is disclosed which includes a vertically disposed rear wall having opposing side edges that are attached to a pair of opposing, vertically disposed side wall assemblies. Each side wall assembly includes an inner panel facing the display section of the device, an outer panel foldably connected to the inner panel and a spacer panel interposed between substantial portions of the inner and outer panels. The inner panels of the side wall assemblies include vertically spaced, cooperating openings to accommodate shelf support members associated with shelves installed in the device. The shelves are inclined to promote gravity feed of product to the front edges of the shelves. A preferred embodiment allows the degree of shelf inclination to be quickly adjusted. An optional bin insert may be used convert one or more shelves into a bin-like structure for holding individual packages of product. The top edges of the side wall assemblies are designed to support a riser assembly on which promotional material relating to the displayed product may be mounted.

20 Claims, 7 Drawing Sheets

MERCHANDISE DISPLAY DEVICE

FIELD OF THE INVENTION

This invention relates to display devices formed primarily from foldable sheet material such as paperboard or corrugated board to store and to display packages of merchandise.

BACKGROUND OF THE INVENTION

Display devices formed from foldable sheet material such as paperboard or corrugated board have long been employed for displaying merchandise items for sale in retail outlets, Such devices have proven to be quite versatile in that they can be designed to accommodate the needs of a particular product. Also, these display devices are relatively inexpensive so that they can be discarded or recycled after they have served their purpose for the display and promotion of the selected product or merchandise.

A number of display devices have been disclosed which include vertically spaced shelves mounted on opposing side wall supports. While such devices have been effective for displaying products for which they were designed, they do not provide a suitable vehicle for all products, particularly those requiring added structural strength for supporting the packages of product on display.

SUMMARY OF THE INVENTION

The presently disclosed invention provides display devices that have unique combinations of features that are especially suited to the simultaneous display of products in the form of individual packages as well as in the form of cartons containing a number of individual packages. The invention also includes optional means for supporting graphic display materials concerning the product on display.

The display device of this invention comprises a) a vertically disposed rear wall formed from corrugated board and having opposing left and right side edges and opposing top and bottom edges, b) a pair of opposing vertically disposed side wall assemblies formed from corrugated board and having opposing front and rear edges and top and bottom edges with the rear edge of each side wall assembly being foldably connected to the respective left or right side edge of the rear wall and c) a plurality of vertically spaced shelves formed from corrugated board and positioned between the opposing side wall assemblies, each shelf having opposing left and right side edges and opposing front and rear edges with the rear edge of the shelf having foldably connected thereto a shelf attachment panel that is secured to the rear wall of the display device and the front edge of the shelf having foldably connected thereto a shelf support panel that is designed for attachment to a shelf support member formed from a substantially rigid material other than corrugated board. Each of the side wall assemblies comprises an inner panel facing the display section of the device and having formed therein a plurality of vertically spaced, cooperating openings located adjacent to the front edge of the side wall assembly, an outer panel foldably connected to the inner panel along the front edge of the side wall assembly, a foldover panel foldably connected to the upper end of the outer panel and designed for folding inwardly and downwardly so that the fold line between the outer panel and the foldably connected foldover panel forms at least a major portion of the top edge of the side wall assembly, and a spacer panel positioned between the inner and outer panels along a major portion of the rear edge of the side wall assembly and extending toward the front edge of the side wall assembly to a point that is intermediate the rear edge of the side wall assembly and the plurality of vertically spaced openings formed in the inner panel of the side wall assembly. The shelf support member attached to the shelf support panel is provided with product retention means as well as means for engaging a pair of cooperating openings in the inner panels of the opposing side wall assemblies with the cooperating openings engaged by the shelf support member being located at a lower elevation than the point of attachment for the rear edge of the shelf to impart a predetermined slope to the shelf that is sufficient to promote gravity feed of displayed products toward the product retention means associated with the shelf support member.

An additional feature of the invention is an optional riser assembly that is formed from corrugated board and is designed for mounting on the top edges of the opposing side wall assemblies. The riser assembly comprises a vertically disposed display panel having opposing top and bottom edges and opposing side edges that are positioned directly above the respective top edges of the opposing side wall assemblies, a pair of vertically disposed side walls foldably connected to the opposing side edges of the display panel and positioned substantially perpendicularly to the display panel with the lower edge of each side wall being provided with tab means for engaging each respective side wall assembly, a pair of vertically disposed back walls positioned behind and in opposing fashion to portions of the display panel with each back wall being foldably connected to the respective side wall edge that is opposite to the edge to which the display panel is connected and the lower end of each back wall being designed to extend below the top edge of the rear wall of the merchandise display device in a contacting relationship with the rear wall, and a stabilizing panel foldably connected to the bottom edge of the display panel and having opposing side edges that are each provided with tab means designed for insertion into a slot formed in the top edge of each side wall assembly.

A further feature of the present invention is an optional removable bin insert that is used in combination with one or more of the vertically spaced shelves to provide a bin that is suitable for holding individual packages of product. Each bin insert comprises a center segment having opposing side edges and opposing front and rear edges along with a pair of opposing side segments foldably connected to the opposing side edges of the center segment with each side segment having a front edge that is continuous with the front edge of the center segment and an opposing rear portion that is provided with bin retention means. The rear edge of the center segment is designed to contact and to be essentially coextensive with the shelf along a line that is adjacent to and parallel with the front edge of the shelf and the rear portion of each side segment having the bin retention means associated therewith is designed for insertion between the respective side edge of the shelf and the respective inner panel of the side wall assembly.

It is a principal object of this invention to provide a merchandise display device having a plurality of vertically spaced, inclined shelves which promote the gravity feed of product packages to the front edges of the shelves for easy removal from the shelves.

It is a further object of the invention to provide a display device having key portions thereof formed from multiple thicknesses of corrugated board to provide added strength for the device.

It is another object of the invention to provide a display device having a plurality of shelves whose degree of inclination can be easily altered.

It is yet another object of the invention to provide a display device having shelves that can be readily converted to a product bin for individual product packages.

It is also an object of the invention to provide a display device capable of supporting graphic display materials relating to the merchandise being displayed.

Yet another object of the invention is to provide blanks for each of the components of the display device which can be partially assembled prior to shipment of the device to facilitate final assembly of the display device at a site where it is to be used.

These objectives and other advantages of the invention will become apparent by carefully examining the following detailed description and the accompanying drawings.

For purposes of clarity, most of the embodiments are illustrated without a full complement of shelves so that other details of the structures will be more readily discernible.

DESCRIPTION OF THE PREFERRED EMBODIMENTS

Figure 1:
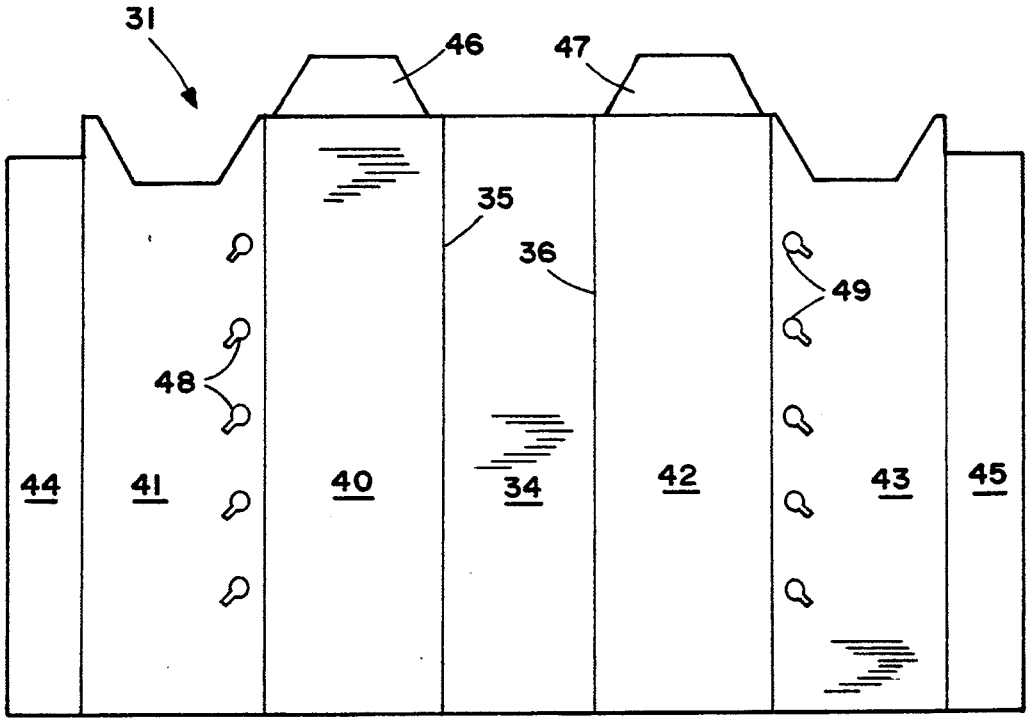
FIG. 1 is a plan view of a blank of foldable sheet material from which one embodiment of this invention may be formed.
Figure 2:
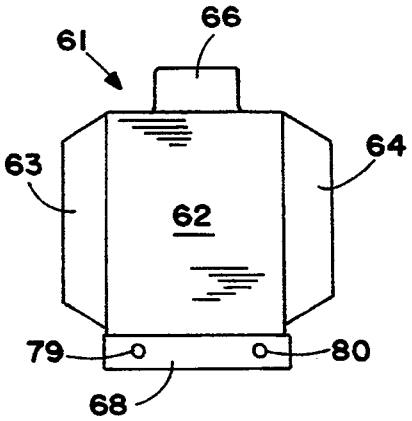
FIG. 2 is a plan view of a blank of foldable sheet material from which a shelf for the presently disclosed display device may be formed.
Figure 3:
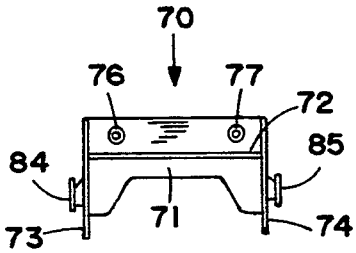
FIG. 3 is a plan view of a shelf support member that is designed for attachment to a shelf formed from the blank shown in FIG. 2.
Figure 4:
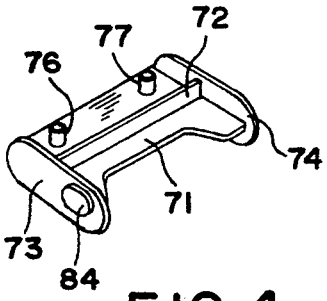
FIG. 4 is a perspective view of the shelf support member shown in FIG. 3.

In accordance with one embodiment of this invention, blank 31 of a foldable sheet material (preferably corrugated board) is shown in FIG. 1. The blank includes a centrally disposed rear wall panel 34 having opposing left and right side-edges 35, 36 and opposing top and bottom edges. Foldably connected to side edges 35, 36 of rear wall panel 34 are a pair of opposing side wall assemblies. The side wall assemblies include outer panels 40, 42 foldably connected to side edges 35, 36, respectively, of panel 34, inner panels 41, 43 foldably connected to outer panels 40, 42 and spacer panels 44, 45 foldably connected to inner panels 41, 43, respectively. Also included in the side wall assemblies are foldover panels 46, 47 which are foldably connected to the top edges of outer panels 40, 42, respectively. Inner panel 41 is provided with a row of spaced, cooperating openings 48 located adjacent to the edge that is connected to outer panel 40 and inner panel 43 is similarly provided with a row of spaced, cooperating openings 49.

Shown in FIGS. 2, 3, 4 and 5 are details of a preferred shelf design that may be used with the display device. Blank 61 includes shelf panel 62 with left and right side edges having foldably connected thereto reinforcement panels 63 and 64. Foldably connected to the rear edge of shelf panel 62 is a shelf attachment panel 66 that is designed for securing to the rear wall of the display device. The front edge of shelf panel 62 has foldably connected thereto a shelf support panel 68 that is designed for attachment to a shelf support member 70 (see FIGS. 3 and 4) that is formed from a substantially rigid material other than corrugated board. Shelf support member 70 may be fabricated from suitable metals, alloys, wood or plastic materials but it is preferably fabricated from a thermoplastic resin such as high-impact polystyrene. Shelf support member 70 includes a flat sheet 71 and cross member 72 extending between opposing side walls 73 and 74. The plane of cross member 72 is disposed transversely to the plane of flat sheet 71 (see FIG. 4) to impart strength and rigidity to shelf support member 70 as well as to define an area that is designed to accommodate shelf support panel 68. Shelf support member 70 is also provided with projections 76, 77 which are designed for insertion into holes 79, 80 formed in shelf support panel 68. The shelf support member 70 and shelf support panel 68 are held together by suitable retainers such as metal clips 82, 83 (see FIG. 5) commonly referred to as pal nuts. It will be appreciated that other means could be employed for holding together the shelf support panel 68 and shelf support member 70 such as suitable adhesives or replacing projections 76, 77 with holes and utilizing screws, washers and nuts to hold panel 68 and support member 70 together. Cross member 72 and flat sheet 71 serve to retain product packages placed on a shelf that has been installed in the display device. Attached to each of side walls 73 and 74 are short extensions 84 and 85, respectively, which include disc-shaped end caps that are designed for insertion into cooperating openings 48, 49 formed in inner panels 41, 43.

Erection of blank 31 is accomplished by first folding spacer panels 44, 45 inwardly until they are brought into contact with the surfaces of inner panels 41, 43, respectively. Inner panels 41, 43 are then folded inwardly so that spacer panel 44 is sandwiched between inner panel 41 and outer panel 40 and spacer panel 45 is sandwiched between inner panel 43 and outer panel 42. Foldover panels 46, 47 are folded downwardly to bring the cut edge of foldover panel 46 into abutment with the top edge of inner panel 41 and the cut edge of foldover panel 47 into abutment with the top edge of inner panel 43 to complete the formation of the side wall assemblies. The two side wall assemblies are then moved into opposing positions as shown in FIG. 6 and it will be seen that a substantial portion of each side wall assembly is made up of three thicknesses of corrugated board to provide adequate strength for supporting merchandise packages displayed in the device.

The shelves for the display device are formed from blank 61 by folding reinforcement panels 63 and 64 downwardly and into contact with the underside surface of shelf panel 62. Reinforcement panels 63 and 64 are preferably secured to the underside surface of shelf panel 62 by a suitable adhesive although appropriate fasteners such as staples or screws could be used for securing the panels. The shelf support panel 68 is attached to shelf support member 70 by guiding projections 76, 77 into holes 79, 80, respectively, in the shelf support panel 68 and installing retainers such as pal nuts on each of projections 76, 77 protruding through the holes. Each assembled shelf is then installed in the display device by securing shelf attachment panel 66 to rear wall 34 at a predetermined location and inserting extensions 84, 85 into an opposing pair of cooperating openings 48, 49 that will position the front edge of each shelf at a lower elevation than the rear edge of the shelf. Each of the cooperating openings 48, 49 includes a short slot that is designed to accommodate the flat portion of short extensions 84, 85 and thereby to maintain the front edge of the installed shelf in a substantially fixed position.

Figure 7:
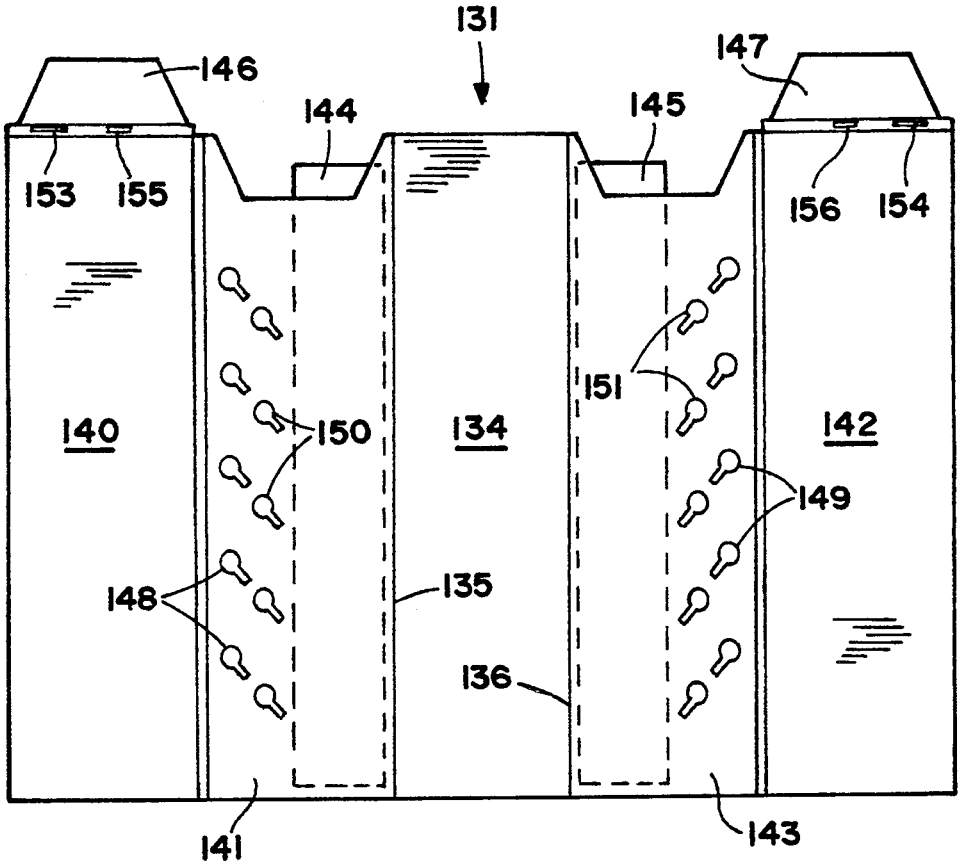
FIG. 7 is a plan view of a blank of foldable sheet material with spacer panels attached thereto from which another embodiment of this invention may be formed.
Figure 8:
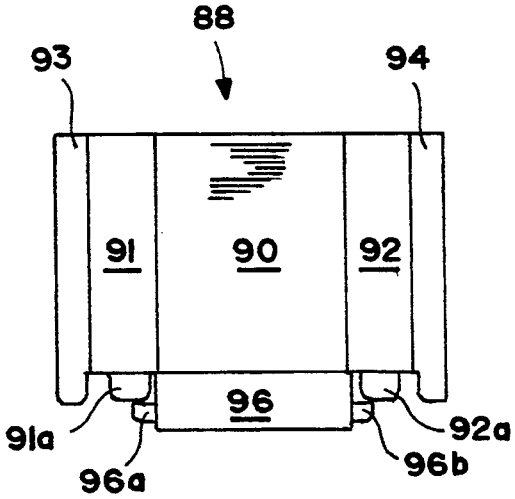
FIG. 8 is a plan view of a blank of foldable sheet material for forming a riser assembly that is designed for mounting on the top edges of the presently disclosed display device.

Shown in FIGS. 7 and 8 are blanks for another embodiment of the present invention. As can be seen in blank 131 of FIG. 7, inner panels 141 and 143 are each provided with a second row of spaced, cooperating openings 150, 151 located adjacent to the first row of openings 148, 149, respectively. Inner panel 141 is disposed between and is foldably connected to outer panel 140 and to the left side edge 135 of rear wall panel 134. The blank is also provided with two parallel, closely spaced score lines extending along the foldable connection between inner and outer panels 141 and 140 to facilitate folding and formation of the front edge of the left side wall assembly. Similarly, inner panel 143 is disposed between and is foldably connected to outer panel 142 and the right side edge 136 of rear wall panel 134. The two score lines between inner and outer panels 143 and 142 facilitate formation of the front edge of the right side wall assembly. Separate spacer panels 144 and 145 are secured to inner panels 141 and 143, respectively, by adhesives or other suitable means so that they will be interposed between the respective inner and outer panels as the blank is erected. After the inner and outer panels have been folded along the front edge of each side wall assembly, foldover panels 146 and 147 are folded downwardly so that the cut edges of foldover panels 146 and 147 are brought into abutting contact with the top edges of the respective inner panels 141 and 143. The top edges of the side wall assemblies are formed by folding along the double score lines disposed between outer panels 140, 142 and the respective foldover panels 146, 147. The top edges of the side wall assemblies are provided with cooperating slots 153, 154, 155 and 156 which are designed to accommodate an optional riser assembly described hereinafter.

Figure 5:
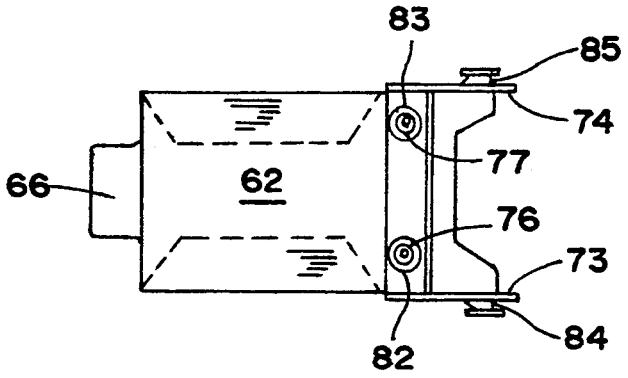
FIG. 5 is a plan view of a shelf for a display device in accordance with this invention which is formed from the blank of FIG. 2 and the shelf support member of FIG. 3.
Figure 6:
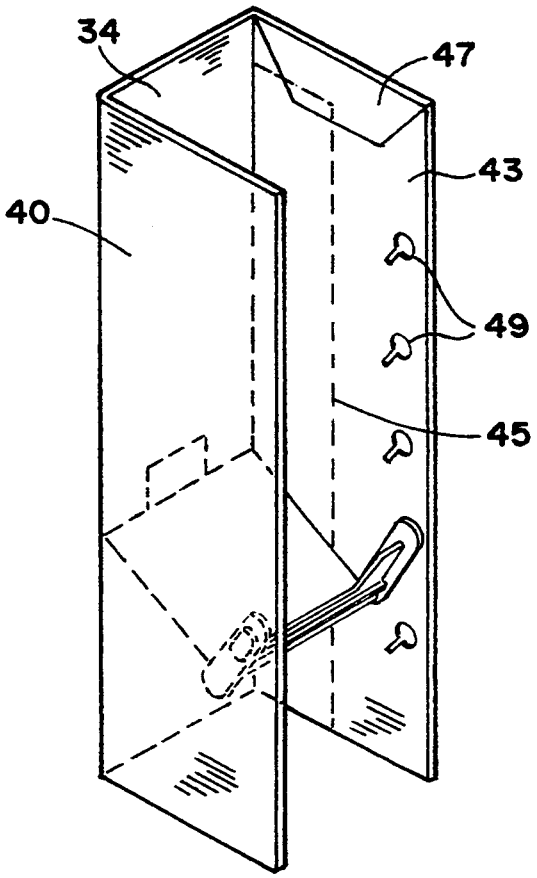
FIG. 6 is a perspective view of a display device formed from the blank shown in FIG. 1 with the shelf of FIG. 5 installed therein.

After blank 131 has been erected to form the support structure for the display device, up to five shelves of the type depicted in FIG. 5 are installed in the structure in a manner analogous to that shown in FIG. 6. The second row of cooperating openings 150, 151 permits a quick and easy adjustment to be made in the position of an installed shelf by simply moving the shelf support member 70 with its attached extensions 84, 85 from a pair of cooperating openings 148, 149 to a pair of cooperating openings 150, 151 in the second row. It is apparent that each of the cooperating openings 148, 149, 150 and 151 must be located in specific areas of the inner panels that are coordinated with the location of shelf attachment panel 66 secured to the rear wall 134 of the display device and the degree of shelf inclination desired. However, the foldable connection between shelf panel 62 and shelf support panel 68 allows a certain degree of flexibility in locating the cooperating openings in the inner panels.

Figure 9:
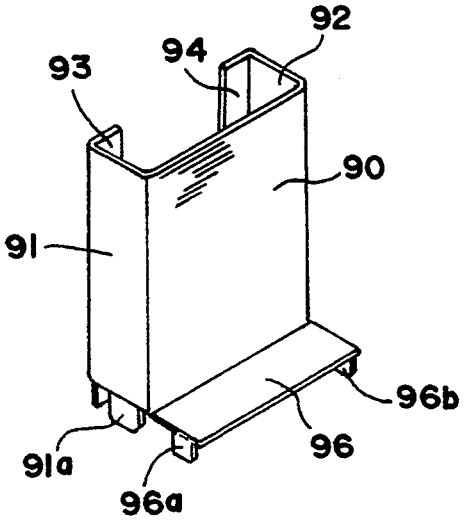
FIG. 9 is a perspective view of the riser assembly that is formed from the blank shown in FIG. 8.

Shown in FIG. 8 is blank 88 for forming the riser assembly of FIG. 9 which includes display panel 90 having opposing top and bottom edges and opposing side edges. Foldably connected to the opposing side edges of display panel 90 are side wall panels 91 and 92 which are provided with tab means 91*a* and 92*a*, respectively, on the lower edge of each side wall panel. Back wall panels 93 and 94 are foldably connected to side wall panels 91 and 92, respectively, and each includes a lower end that is designed to extend below the top edge of the rear wall of the display device when the riser assembly is installed on the top edge of the display device. Foldably connected to the bottom edge of display panel 90 is stabilizing panel 96 which has opposing side edges that are provided with tab means 96*a* and 96*b*. The formed riser assembly shown in FIG. 9 is designed for installation on a support structure formed from blank 131 shown in FIG. 7 and it provides a prominent location for displaying graphic and/or promotional material relating to the product on display. Tab means 91*a* and 92*a* are inserted into slots 153 and 154, respectively, while the lower ends of back wall panels 93 and 94 engage the front surface of rear wall 134. Tab means 96*a* and 96*b* on stabilizing panel 96 are inserted into slots 155 and 156, respectively.

Figure 10:
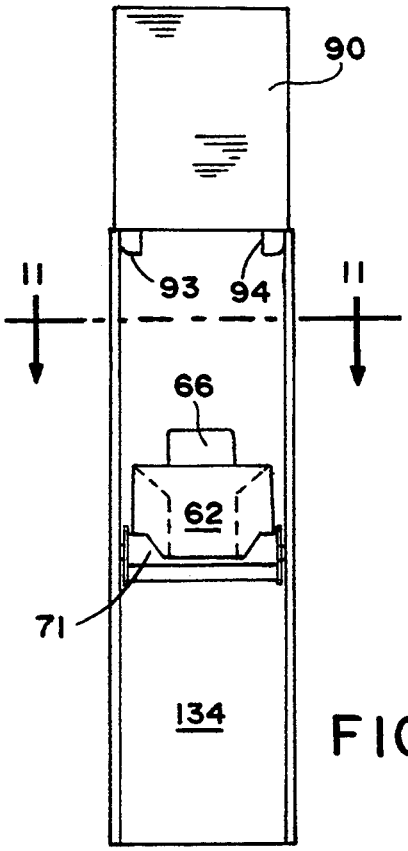
FIG. 10 is a front elevational view of a display device formed from the blank shown in FIG. 7 which includes the riser assembly of FIG. 9 mounted on the top edges of the display stand and the shelf shown in FIG. 5 installed in the display portion of the device.
Figure 11:
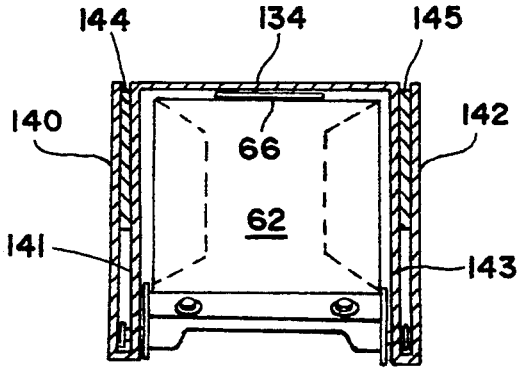
FIG. 11 is a sectional view taken along the line 11—11 in FIG. 10.
Figure 12:
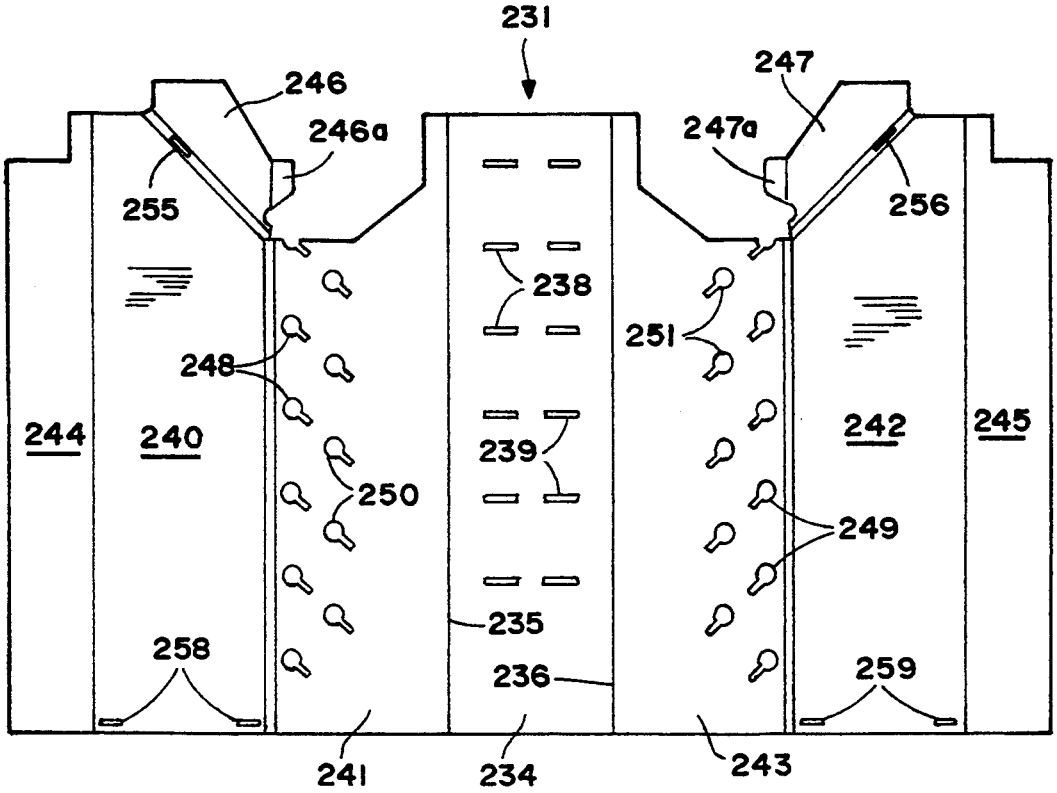
FIG. 12 is a plan view of a blank of foldable sheet material from which a further embodiment of this invention may be formed.

The front elevational view in FIG. 10 shows a support structure formed from blank 131 (FIG. 7) with the riser assembly of FIG. 9 installed on the top edges of the side wall assemblies. A representative shelf assembly of the type shown in FIGS. 2–5 is adhesively secured to rear wall 134 by shelf attachment panel 66 and the front edge of the shelf assembly is supported by shelf support member 70 and associated flat sheet 71 in conjunction with cooperating openings in the inner panels of the opposing side wall assemblies. Additional details of construction are shown in the sectional view of FIG. 11.

Another preferred embodiment of the invention is shown in FIGS. 12 through 20. Blank 231 formed from corrugated board includes rear wall panel 234 having opposing left and right side edges 235 and 236, respectively, and interposed between side edges 235 and 236 are a plurality of spaced slots 238 and 239 arranged in pairs. Foldably connected to side edges 235 and 236 are inner panels 241 and 243, respectively, which are each provided with two rows of spaced openings. Inner panel 241 with two rows 248, 250 of spaced openings is foldably connected to outer panel 240 along a double score line which, when folded, forms the front edge of the left side wall assembly. Outer panel 240 is provided with two slots 258 located adjacent to the edge of panel 240 that will become the bottom edge of the erected display device. A major portion of the top edge of outer panel 240 has foldably connected thereto along a double score line foldover panel 246. The double scored fold line at the top edge of outer panel 240 is designed to produce a top edge on the left side wall assembly that is inclined with its lowest point located adjacent to the highest point of the front edge of the left side wall assembly. The inclined portion of the top edge of the left side wall assembly is provided with slot 255 which is designed to accommodate tab means associated with an optional riser assembly that may be installed on top of the display device formed from blank 231. Spacer panel 244 is foldably connected to the side edge of outer panel 240 that is opposite to the side edge connected to inner panel 241. During erection of the left side wall assembly, spacer panel 244 is brought into contact with the surface of outer panel 240 so that spacer panel 244 is interposed between outer panel 240 and inner panel 241. Foldover panel 246 has foldably connected thereto a minispacer panel 246*a* that is positioned between outer panel 240 and foldover panel 246 as the latter is folded downwardly to form a major portion of the top edge of the left side wall assembly. Preferably, foldover panel 246 is held in its folded down position by the application of suitable adhesives. Spacer panel 244 and minispacer panel 246*a* provide precise spacing to insure that the cut edges of foldover panel 246 and the top edge of inner panel 241 are in perfect abutting alignment. The panels associated with blank 231 for forming the right side wall assembly include inner panel 243 with two rows 249, 251 of spaced openings, outer panel 242 with two slots 259, spacer panel 245 and foldover panel 247 with foldably connected minispacer panel 247*a*. The double scored fold line between foldover panel 247 and outer panel 242 is provided with slot 256. The arrangement and function of the various elements which form the right side wall assembly are analogous to those described above for the left side wall assembly.

Figure 13:
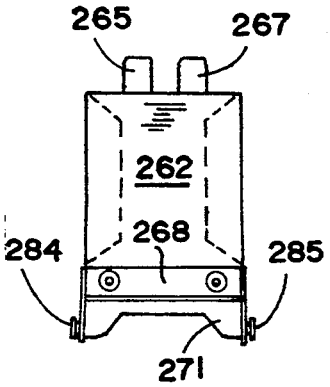
FIG. 13 is a plan view of a shelf with attached shelf support member that is suitable for use with the presently disclosed invention.

FIG. 13 depicts a shelf assembly that is similar in construction to that shown in FIG. 5 except that the rear edge of shelf panel 262 has foldably connected thereto tab means 265 and 267 which are designed for insertion into a pair of slots 238, 239 formed in the rear wall 234 of the display device. Shelf support panel 268 is attached to a shelf support member having extensions 284 and 285 that are designed to engage a pair of cooperating openings in the opposing inner panels of the display device.

Figure 14:
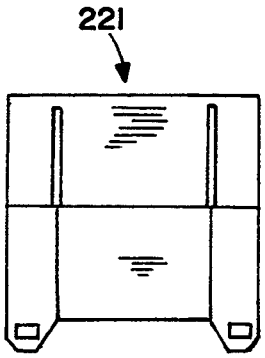
FIG. 14 is a plan view of a blank of foldable sheet material from which a product bin insert may be formed.
Figure 15:
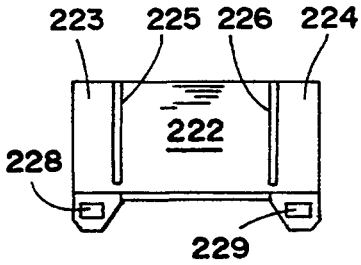
FIG. 15 is a plan view of the blank of FIG. 14 after it has been folded once.
Figure 16:
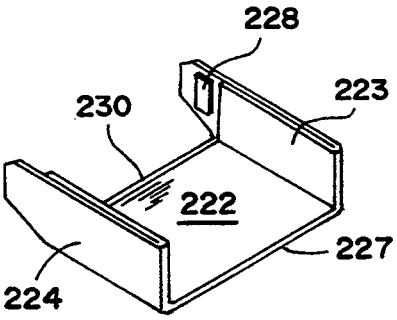
FIG. 16 is a perspective view of the product bin insert formed from the folded blank shown in FIG. 15.

Shown in FIG. 14 is a blank 221 from which an optional removable bin insert is formed. Blank 221 is first folded nearly in half as depicted in FIG. 15 to form a bin insert having a center segment 222 with a pair of opposing side segments 223, 224 foldably connected thereto. Slots 225 and 226 are provided to facilitate folding the bin insert into the form shown in FIG. 16 wherein the front edge of each side segment is continuous with the front edge 227 of center segment 222. The rear portion of each side segment is provided with bin retention means 228, 229 (FIG. 15) which comprise short strips of plastic, cardboard, wood or other suitable material secured to each side segment as indicated. The thickness of the applied strips should be such that the rear portions of the side segments can be inserted between the side edges of a shelf installed in the display device and the inner panels of each side wall assembly while, at the same time, having sufficient thickness to be retained by the side edges of the shelf. When the bin is inserted into the display device, the rear edge 230 of center segment 222 will contact and be essentially coextensive with shelf panel 262 along a line that is adjacent to the front edge of the shelf.

Figure 17:
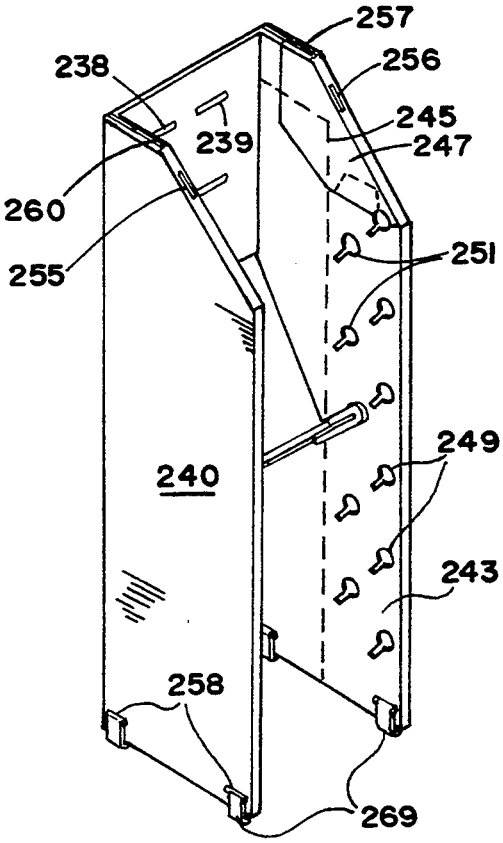
FIG. 17 is a perspective view of a display device formed from the blank shown in FIG. 12 and including their shelf of FIG. 13 installed therein.
Figure 18:
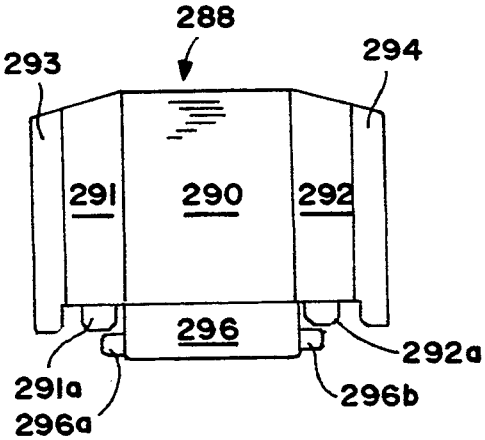
FIG. 18 is a plan view of a blank of foldable sheet material for forming a riser assembly having an alternative design.
Figure 19:
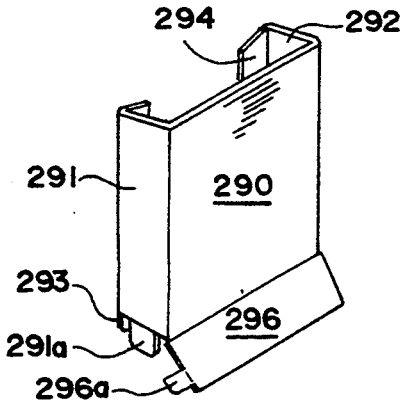
FIG. 19 is a perspective view of a riser assembly formed from the blank shown in FIG. 18.
Figure 20:
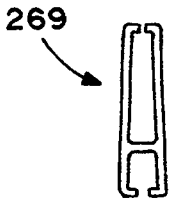
FIG. 20 is an enlarged end elevational view of a clip-on support that is designed for attachment to the bottom edges of the display device.

The display device shown in FIG. 17 is formed from blank 231 and includes a representative shelf installed therein. It should be noted that a portion of spacer panel 245 extends into the area behind foldover panel 247 but remains below the top edge of the right side wall assembly. Thus, spacer panel 245 does not interfere with tab means inserted into slot 256 and cavity 257 that is disposed between outer panel 242 and foldover panel 247 and is formed when foldover panel 247 is moved into place. The dimensions of cavity 257 are also determined in part by the narrow portion of spacer panel 245 that extends to the top edge of the right side wall assembly. The left side wall assembly is similarly constructed with the dimensions of cavity 260 being determined in part by a portion of spacer panel 244, outer panel 240 and foldover panel 246. Cavities 257 and 260 along with slots 255 and 256 are designed to accommodate tab means associated with a riser assembly such as those shown in FIGS. 9 and 19. The riser assembly shown in FIG. 19 is formed from blank 288 shown in FIG. 18 and includes display panel 290, side wall panels 291 and 292 with associated tab means 291*a* and 292*a*, back wall panels 293, 294 and stabilizing panel 296 with its associated tab means 296*a* and 296*b*. The formed riser assembly (FIG. 19) is installed on the top edges of the side wall assemblies (FIG. 17) by inserting tab means 291*a* and 292*a* into cavities 260 and 257, respectively, while guiding the lower ends of back wall panels 293 and 294 into the display portion of the device where they are in contact with the front surface of rear wall panel 234. Tab means 296*a* and 296*b* associated with stabilizing panel 296 are inserted into slots 255 and 256, respectively. If desired, display panel 290 may be provided with one or more adhesive strips equipped with removable covers to allow easy and quick mounting on the display panel of graphic and/or promotional material concerning the product on display. Although not essential, it is preferred that the bottom edges of the side wall assemblies be provided with clip-on supports 269 formed from a resilient metal or thermoplastic material and designed to engage slots 258 and 259 near the lower edges of outer panels 240 and 242, respectively. An end elevational view of clip-on support 269 is shown in FIG. 20.

Figure 21:
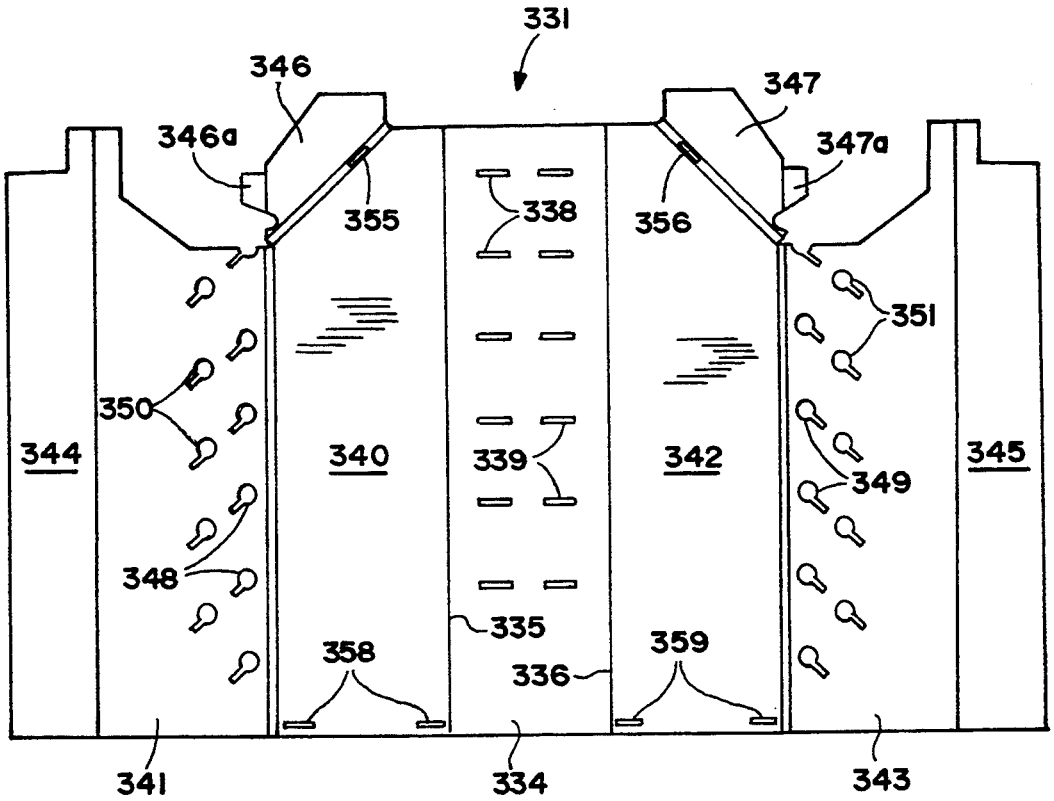
FIG. 21 is a plan view of a blank of foldable sheet material from which another embodiment of this invention may be formed.
Figure 22:
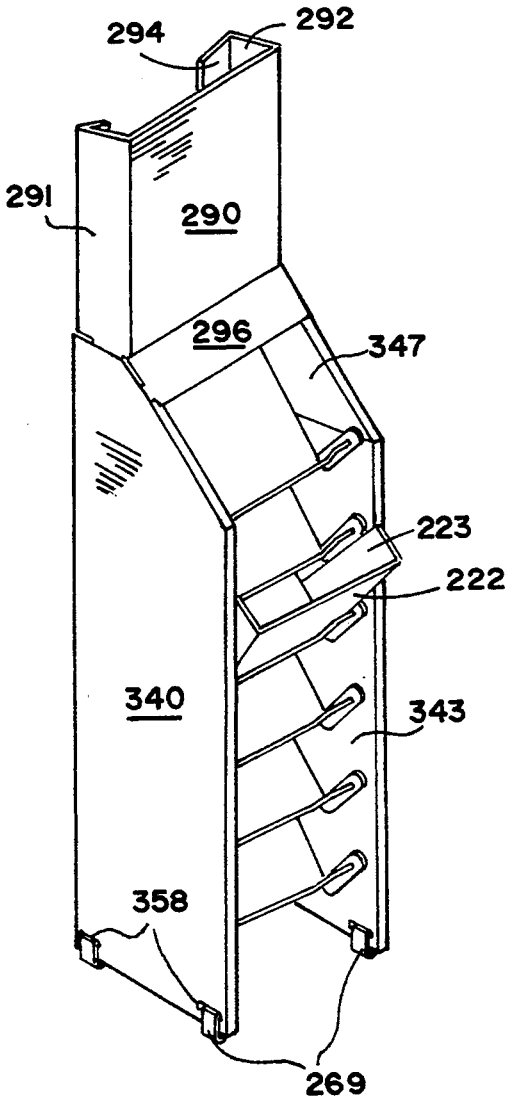
FIG. 22 is a perspective view of a display device formed from the blank shown in FIG. 21 which includes the riser assembly of FIG. 19, a plurality of shelves of the type shown in FIG. 13 and the product bin insert shown in FIG. 16.
Figure 23:
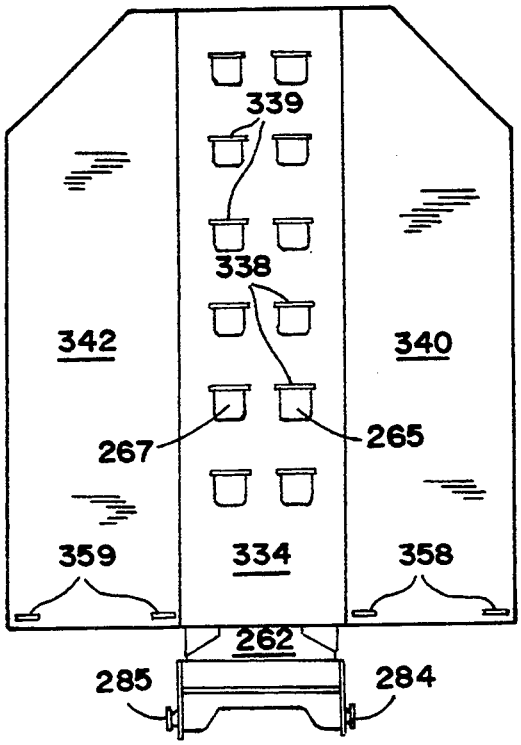
FIG. 23 is a plan view of a partially erected display device formed from the blank shown in FIG. 21 which includes a plurality of shelves of the type shown in FIG. 13 secured to the rear wall panel of the blank.

Another embodiment of this invention is shown in FIGS. 21, 22 and 23. Blank 331 formed from corrugated board includes rear wall panel 334 having opposing left and right side edges 335 and 336, opposing top and bottom edges and a plurality of spaced slots 338 and 339 which are arranged in pairs. Also included is a left side wall assembly that comprises an inner panel 341, an outer panel 340 disposed between and having opposing side edges foldably connected to a side edge of the inner panel 341 and the left side edge 335 of rear wall panel 334, a spacer panel 344 foldably connected to a major portion of the side edge of the inner panel 341 that is opposite to the inner panel side edge to which outer panel 340 is connected and a foldover panel 346 foldably connected to the top edge of outer panel 340. Inner panel 341 is provided with at least one row of spaced openings 348 and, preferably, a second row of spaced openings 350. It is preferred that outer panel 340 and inner panel 341 be foldably connected along a double score line which, when folded, forms the front edge of the left side wall assembly. The foldable connection between outer panel 340 and foldover panel 346 is provided with two parallel, closely spaced score lines that are designed to produce a top edge on the left side wall assembly that is inclined with its lowest point located adjacent to the highest point of the front edge of the left side wall assembly. The double scored foldable connection between outer panel 340 and foldover panel 346 is provided with slot 355 which is designed to accommodate tab means associated with an optional riser assembly that may be installed on top of the display device formed from blank 331. Outer panel 340 is provided with two slots 358 located adjacent to the edge of outer panel 340 that will become the bottom edge of the erected display device. Foldover panel 346 has foldably connected thereto minispacer panel 346*a* that is designed to be positioned between outer panel 340 and foldover panel 346 when blank 331 is erected. In an analogous manner, blank 331 includes a right side wall assembly that comprises inner panel 343, outer panel 342 foldably connected to the right side edge 336 of rear wall panel 334, spacer panel 345 and foldover panel 347. Inner panel 343 is provided with at least one row of spaced openings 349 and, preferably, a second row of spaced openings 351. Outer panel 342 and inner panel 343 are foldably connected along two parallel, closely spaced score lines that form the front edge of the right side wall assembly when blank 331 is erected. The foldable connection between outer panel 342 and foldover panel 347 is provided with two parallel, closely spaced score lines and slot 356 which is designed to accommodate tab means associated with an optional riser assembly that may be installed on top of the display device formed from blank 331. Outer panel 342 is provided with two slots 359 located adjacent to the edge of outer panel 342 that will become the bottom edge of the erected display device. Foldover panel 347 has foldably connected thereto minispacer panel 347*a* that is designed to be positioned between outer panel 342 and foldover panel 347 when blank 331 is erected.

Blank 331 is formed into the display device shown in FIG. 22 with a full complement of shelves and a riser assembly. The shelves are identical to the design depicted in FIG. 13 and the riser assembly is the same as that shown in FIG. 19. One of the shelves in the FIG. 22 device is provided with a removable bin insert of the type shown in FIG. 16 but it will be apparent that additional bin inserts could be used simultaneously with the device. The outward appearance of the device shown in FIG. 22 is very similar to that of the FIG. 17 embodiment. In the FIG. 22 device, spacer panels 344 and 345 are essentially completely concealed from view because the foldable connections between spacer panels 344, 345 and inner panels 341, 343, respectively, are positioned in virtual contact with the foldable connections between outer panels 340, 342 and the rear wall 334. Such is not the case in the FIG. 17 embodiment where spacer panels 244, 245 are foldably connected to outer panels 240, 242, respectively.

Since the blanks used for forming the rear wall and attached side wall assemblies of this invention may be rather large and unwieldy, it is desirable to convert the blanks into a more compact form for shipment to the site where final assembly of the display device is to be accomplished. The various embodiments described above lend themselves to partial assembly before shipment to a final destination. The partial assembly involves formation of the side wall assemblies and installation of shelves including the application of adhesives or other means for securing the various panels to the intended structural components. Partial assembly of the FIG. 21 embodiment is shown in FIG. 23 as viewed from the back side of blank 331 after spacer panels 344, 345 and inner panels 341, 343 have been folded inwardly and foldover panels 346, 347 have been folded downwardly into an abutting relationship with the top edges of inner panels 341 and 343, respectively. A full complement of shelves have been installed in rear wall panel 334 by inserting tab means 265, 267 attached to the rear edge of each shelf panel 262 into slots 338, 339 and adhesively securing tab means 265, 267 to the rear surface of rear wall panel 334. The partially assembled blank may be made even more compact by folding one side wall assembly along its foldable connection with rear wall panel 334 until the side wall assembly is in contact with tab means 265, 267 secured to the rear surface of rear wall panel 334. It is apparent that the compactness of each partially assembled display device design will be determined by the design itself, including the dimensions of the rear wall panel 334 and the side wall assemblies.

Partial assembly of other embodiments described above may be effected in a manner similar to that indicated for the FIG. 21 embodiment. Further manipulation of the partially assembled devices to render them more compact for shipping purposes will be apparent to those skilled in the art.

Since the various embodiments described above are fabricated primarily from cardboard or corrugated board, it is preferred that adhesives be used in the assembly of the display devices. Suitable adhesives include aqueous formulations based on starch or dextrins and nonaqueous formulations based on synthetic resins. The nonaqueous adhesives include hot-melt formulations which are capable of quickly forming strong bonds between treated surfaces.

Various embodiments of the present invention have been described above but it is apparent that other modifications could be made based on the teachings contained herein. Such modifications are deemed to be a part of this invention as defined by the scope of the appended claims.

What is claimed is:

1. A merchandise display device comprising a) a vertically disposed rear wall formed from corrugated board and having opposing left and right side edges and opposing top and bottom edges, b) a pair of opposing, vertically disposed side wall assemblies formed from corrugated board, each side wall assembly having opposing front and rear edges and top and bottom edges with the rear edge of one side wall assembly being foldably connected to the left side edge of said rear wall and the rear edge of the other side wall assembly being foldably connected to the right side edge of said rear wall, each of the side wall assemblies being further characterized as comprising i) an inner panel facing the display section of the device and having formed therein a plurality of vertically spaced, cooperating openings located adjacent to the front edge of the side wall assembly, ii) an outer panel foldably connected to the inner panel along the front edge of the side wall assembly, said outer panel having a foldover panel foldably connected to its upper end with the foldover panel being designed for folding inwardly and downwardly so that the fold line between the outer panel and the foldably connected foldover panel forms at least a major portion of the top edge of the side wall assembly, and iii) a spacer panel positioned between said inner and outer panels along a major portion of the rear edge of the side wall assembly and extending toward the front edge of the side wall assembly to a point that is intermediate the rear edge of the side wall assembly and said plurality of vertically spaced openings formed in the inner panel of the side wall assembly, and c) a plurality of vertically spaced shelves formed from corrugated board and positioned between the opposing side wall assemblies, each shelf having opposing left and right side edges and opposing front and rear edges with the rear edge of the shelf having foldably connected thereto a shelf attachment panel that is secured to said rear wall of the display device and the front edge of the shelf having foldably connected thereto a shelf support panel that is designed for attachment to a shelf support member, the shelf support member including means for engaging a pair of cooperating openings in the inner panels of the opposing side wall assemblies with said pair of cooperating openings engaged by the shelf support member being located at a lower elevation than the point of attachment for the rear edge of the shelf to impart a predetermined slope to the shelf sufficient to promote gravity feed of of displayed products to the front edge of the shelf and means associated with said shelf support member for retaining displayed products placed on the shelf.

2. The device of claim 1 wherein the inner and outer panels of each side wall assembly are foldably connected along two parallel, closely spaced score lines to create a front edge of each side wall assembly that has a predetermined width.

3. The device of claim 2 wherein the outer panel and attached foldover panel of each side wall assembly are foldably connected along two parallel, closely spaced score lines to create a top edge having a width that is substantially the same as the width of the front edge of each side wall assembly.

4. The device of claim 3 wherein the foldover panel foldably connected to the outer panel of each side wall assembly is designed to produce a top edge on the side wall assembly that is inclined with the lowest point of the top edge being adjacent to the highest point of the front edge of the side wall assembly and a substantial portion of the cut edge of the downwardly extending foldover panel is designed to form an abutting relationship with the upper edge of the inner panel of the side wall assembly.

5. The device of claim 4 wherein said spacer panel positioned between said inner and outer panels of each side wall assembly is foldably connected to said outer panel along a major portion of the rear edge of the side wall assembly and said inner panel of each side wall assembly is foldably connected to the respective side edge of said rear wall.

6. The device of claim 5 which additionally includes a slot formed in the top edge of each side wall assembly and a riser assembly formed from corrugated board that is mounted on the top edges of the opposing side wall assemblies, said riser assembly comprising a) a vertically disposed display panel having opposing top and bottom edges and opposing side edges that are positioned directly above the respective top edges of said opposing side wall assemblies, b) a pair of vertically disposed side walls foldably connected to the opposing side edges of the display panel and positioned substantially perpendicularly to the display panel with the lower edge of each side wall being provided with tab means for engaging each respective side wall assembly and for holding the riser assembly in a substantially fixed position when mounted on the top edges of the opposing side wall assemblies, c) a pair of vertically disposed back walls positioned behind and in opposing fashion to portions of the display panel, each back wall being foldably connected to the respective side wall edge that is opposite to the edge to which the display panel is connected and having a lower end that is designed to extend below the top edge of the rear wall of the merchandise display device in a contacting relationship with the front surface of the rear wall, and d) a stabilizing panel foldably connected to the bottom edge of the display panel and having opposing side edges that are each provided with tab means designed for insertion into the respective slot formed in the top edge of each side wall assembly and for stabilizing the position of the riser assembly mounted on the top edges of the opposing side wall assemblies.

7. The device of claim 4 wherein said spacer panel positioned between said inner and outer panels of each side wall assembly is foldably connected to said inner panel along a major portion of the rear edge of the side wall assembly and said outer panel of each side wall assembly is foldably connected to the respective side edge of said rear wall.

8. The device of claim 6 which additionally includes a slot formed in the top edge of each side wall assembly and a riser assembly formed from corrugated board that is mounted on the top edges of the opposing side wall assemblies, said riser assembly comprising a) a vertically disposed display panel having opposing top and bottom edges and opposing side edges that are positioned directly above the respective top edges of said opposing side wall assemblies, b) a pair of vertically disposed side walls foldably connected to the opposing side edges of the display panel and positioned substantially perpendicularly to the display panel with the lower edge of each side wall being provided with tab means for engaging each respective side wall assembly and for holding the riser assembly in a substantially fixed position when mounted on the top edges of the opposing side wall assemblies, c) a pair of vertically disposed back walls positioned behind and in opposing fashion to portions of the display panel, each back wall being foldably connected to the respective side wall edge that is opposite to the edge to which the display panel is connected and having a lower end that is designed to extend below the top edge of the rear wall of the merchandise display device in a contacting relationship with the front surface of the rear wall, and d) a stabilizing panel foldably connected to the bottom edge of the display panel and having opposing side edges that are each provided with tab means designed for insertion into the respective slot formed in the top edge of each side wall assembly and for stabilizing the position of the riser assembly mounted on the top edges of the opposing side wall assemblies.

9. A merchandise display device having a display section for displaying packages of product comprising in combination a) a vertically disposed rear wall formed from corrugated board and having opposing left and right side edges and opposing top and bottom edges, b) a pair of opposing, vertically disposed side wall assemblies formed from corrugated board, each side wall assembly having opposing front and rear edges and top and bottom edges with the rear edge of one side wall assembly being foldably connected to the left side edge of said rear wall and the rear edge of the other side wall assembly being foldably connected to the right side edge of said rear wall to define the display section disposed between the opposing side wall assemblies, each of the side wall assemblies being further characterized as comprising i) an inner panel and an outer panel foldably connected and folded along a double score line to form said front edge of the side wall assembly with the inner panel facing the display section of the device, ii) a foldover panel foldably connected to the upper edge of the outer panel and folded along a double score line to form a major portion of the top edge of the side wall assembly with substantial portions of the cut edge of the foldover panel and the top edge of the inner panel being designed to form an abutting relationship in the formed side wall assembly, said major portion of the top edge of the side wall assembly being inclined and having its lowest point located adjacent to the highest point of said front edge of the side wall assembly, iii) a first row of vertically arranged and spaced, cooperating openings formed in the inner panel adjacent to the front edge of the side wall assembly and a second row of vertically arranged and spaced, cooperating openings formed in the inner panel rearwardly of said first row of openings, and iv) a spacer panel positioned between said inner and outer panels along a major portion of the rear edge of the side wall assembly and extending toward the front edge of the side wall assembly to a point that is intermediate the rear edge of the side wall assembly and said second row of vertically arranged and spaced, cooperating openings formed in the inner panel, and c) a plurality of vertically spaced shelves formed from corrugated board and disposed between the opposing side wall assemblies, each shelf having opposing left and right side edges and opposing front and rear edges with the rear edge of the shelf having foldably connected thereto tab means secured to the rear wall of the display device for supporting the rear edge of the shelf, said left and right side edges having foldably connected to each a shelf reinforcement panel designed for folding under and attaching to the underside of the shelf, said front edge of the shelf having foldably connected thereto a shelf support panel designed for attachment to a shelf support member that is formed from a thermoplastic material, said shelf support member including means for retaining displayed product packages placed on the shelf and for engaging vertically arranged and spaced, cooperating openings in the inner panel of each side wall assembly that are located at a sufficiently lower elevation than the secured rear edge of the shelf to provide an inclined shelf that will promote gravity feed of product packages to the front edge of the shelf.

10. The device of claim 9 wherein said spacer panel positioned between said inner and outer panels of each side wall assembly is foldably connected to said outer panel along a major portion of the rear edge of the side wall assembly, said inner panel of each side wall assembly is foldably connected to the respective side edge of said rear wall and said rear wall is provided with a plurality of vertically spaced slots for receiving said tab means foldably connected to the rear edges of said plurality of vertically spaced shelves.

11. The device of claim 10 which additionally includes a slot formed in the top edge of each side wall assembly and a riser assembly formed from corrugated board that is mounted on the top edges of the opposing side wall assemblies, said riser assembly comprising a) a vertically disposed display panel having opposing top and bottom edges and opposing side edges that are positioned directly above the respective top edges of said opposing side wall assemblies, b) a pair of vertically disposed side walls foldably connected to the opposing side edges of the display panel and positioned substantially perpendicularly to the display panel with the lower edge of each side wall being provided with tab means for engaging each respective side wall assembly and for holding the riser assembly in a substantially fixed position when mounted on the top edges of the opposing side wall assemblies, c) a pair of vertically disposed back walls positioned behind and in opposing fashion to portions of the display panel, each back wall being foldably connected to the respective side wall edge that is opposite to the edge to which the display panel is connected and having a lower end that is designed to extend below the top edge of the rear wall of the merchandise display device in a contacting relationship with the front surface of the rear wall, and d) a stabilizing panel foldably connected to the bottom edge of the display panel and having opposing side edges that are each provided with tab means designed for insertion into the respective slot formed in the top edge of each side wall assembly and for stabilizing the position of the riser assembly mounted on the top edges of the opposing side wall assemblies.

12. The device of claim 11 wherein at least one of the shelves is provided with a removable bin insert comprising a center segment having opposing side edges and opposing front and rear edges, a pair of opposing side segments foldably connected to the opposing side edges of the center segment with each side segment having a front edge that is continuous with the front edge of the center segment and an opposing rear portion that is provided with bin retention means for holding the removable bin insert in its installed position, the rear edge of said center segment being designed to contact and to be coextensive with the shelf along a line that is adjacent to the front edge of the shelf and the rear portion of each side segment with the bin retention means associated therewith being designed for insertion between the respective side edge of the shelf and the inner panel of the side wall assembly.

13. The device of claim 9 wherein said spacer panel positioned between said inner and outer panels of each side wall assembly is foldably connected to said inner panel along a major portion of the rear edge of the side wall assembly, said outer panel of each side wall assembly is foldably connected to the respective side edge of said rear wall and said rear wall is provided with a plurality of vertically spaced slots for receiving said tab means foldably connected to the rear edges of said plurality of vertically spaced shelves.

14. The device of claim 13 which additionally includes a slot formed in the top edge of each side wall assembly and a riser assembly formed from corrugated board that is mounted on the top edges of the opposing side wall assemblies, said riser assembly comprising a) a vertically disposed display panel having opposing top and bottom edges and opposing side edges that are positioned directly above the respective top edges of said opposing side wall assemblies, b) a pair of vertically disposed side walls foldably connected to the opposing side edges of the display panel and positioned substantially perpendicularly to the display panel with the lower edge of each side wall being provided with tab means for engaging each respective side wall assembly and for holding the riser assembly in a substantially fixed position when mounted on the top edges of the opposing side wall assemblies, c) a pair of vertically disposed back walls positioned behind and in opposing fashion to portions of the display panel, each back wall being foldably connected to the respective side wall edge that is opposite to the edge to which the display panel is connected and having a lower end that is designed to extend below the top edge of the rear wall of the merchandise display device in a contacting relationship with the front surface of the rear wall, and d) a stabilizing panel foldably connected to the bottom edge of the display panel and having opposing side edges that are each provided with tab means designed for insertion into the respective slot formed in the top edge of each side wall assembly and for stabilizing the position of the riser assembly mounted on the top edges of the opposing side wall assemblies.

15. The device of claim 14 wherein at least one of the shelves is provided with a removable bin insert comprising a center segment having opposing side edges and opposing front and rear edges, a pair of opposing side segments foldably connected to the opposing side edges of the center segment with each side segment having a front edge that is continuous with the front edge of the center segment and an opposing rear portion that is provided with bin retention means for holding the removable bin insert in its installed position, the rear edge of said center segment being designed to contact and to be coextensive with the shelf along a line that is adjacent to the front edge of the shelf and the rear portion of each side segment with the bin retention means associated therewith being designed for insertion between the respective side edge of the shelf and the inner panel of the side wall assembly.

16. A blank for forming a vertically disposed merchandise display device from a sheet of corrugated board comprising a) a rear wall panel having opposing left and right side edges and opposing top and bottom edges, b) a pair of side wall assemblies with each assembly including an outer panel with opposing side edges and opposing top and bottom edges, an inner panel having opposing side edges foldably connected to a side edge of the outer panel and the respective left or right side edge of the rear wall panel and a foldover panel foldably connected to the top edge of the outer panel, c) a spacer panel foldably connected to a major portion of the side edge of the outer panel that is opposite to the outer panel side edge to which the inner panel is connected, and d) a first row of spaced, cooperating openings formed in each inner panel adjacent to the side edge that is foldably connected to the outer panel.

17. The blank of claim 16 wherein a major proportion of the edge of said foldover panel other than the edge that is foldably connected to the outer panel and substantially all of the top edge of the inner panel are designed to form an abutting relationship when the foldover panel is folded into place.

18. The blank of claim 17 wherein the foldable connections between the outer and inner panels and between the outer and foldover panels are provided with parallel, closely spaced score lines and the inner panel is provided with a second row of spaced, cooperating openings located adjacent to said first row of spaced, cooperating openings and between said first row of openings and the side edge of the inner panel that is foldably connected to the rear wall panel.

19. The blank of claim 18 wherein each side wall assembly is folded along the foldable connections between the outer panel and the spacer, inner and foldover panels and is secured in its folded form by adhesive means for adhesively attaching the spacer panel to each of the outer, inner and foldover panels with the spacer panel positioned between the outer and inner panels and the foldover panel positioned in abutting relationship to the top edge of the inner panel.

20. The blank of claim 19 wherein the rear wall panel is provided with a plurality of spaced slots and the blank additionally includes a plurality of shelves with tab means associated with the rear edge of each shelf being inserted into said spaced slots and secured to said rear wall panel, said tab means being designed to support the rear edge of each shelf when the blank is formed into a vertically disposed merchandise display device.

* * * * *